US008241091B2

(12) United States Patent
Takeichi

(10) Patent No.: US 8,241,091 B2
(45) Date of Patent: Aug. 14, 2012

(54) EYEGLASS LENS PROCESSING APPARATUS

(75) Inventor: Kyoji Takeichi, Aichi (JP)

(73) Assignee: Nidek Co., Ltd., Aichi (JP)

( * ) Notice: Subject to any disclaimer, the term of this patent is extended or adjusted under 35 U.S.C. 154(b) by 327 days.

(21) Appl. No.: 12/699,437

(22) Filed: Feb. 3, 2010

(65) Prior Publication Data

US 2010/0197198 A1 Aug. 5, 2010

(30) Foreign Application Priority Data

Feb. 4, 2009 (JP) ..... P2009-024193

(51) Int. Cl.
*B24B 49/00* (2012.01)

(52) U.S. Cl. ..... 451/5; 451/9; 451/10; 451/42; 451/43; 451/44; 451/255

(58) Field of Classification Search ..... 451/5, 41, 451/42, 43, 44, 9, 10, 255, 256
See application file for complete search history.

(56) References Cited

U.S. PATENT DOCUMENTS

| | | | | |
|---|---|---|---|---|
| 4,612,736 | A * | 9/1986 | Massard et al. | 451/5 |
| 5,149,337 | A * | 9/1992 | Watanabe | 451/43 |
| 5,890,949 | A * | 4/1999 | Shibata | 451/5 |
| 6,045,432 | A * | 4/2000 | Shibata | 451/5 |
| 6,089,957 | A * | 7/2000 | Shibata | 451/41 |
| 6,220,926 | B1 * | 4/2001 | Mizuno | 451/5 |
| 6,790,124 | B2 | 9/2004 | Shibata | |
| 6,817,929 | B2 * | 11/2004 | Kobayashi et al. | 451/42 |
| 6,848,969 | B2 * | 2/2005 | Luderich | 451/5 |
| 7,617,579 | B2 * | 11/2009 | Natsume | 29/26 A |
| 8,007,344 | B2 * | 8/2011 | Obayashi et al. | 451/5 |
| 2004/0192170 | A1 * | 9/2004 | Mizun | 451/5 |
| 2007/0264906 | A1 * | 11/2007 | Yamamoto et al. | 451/5 |

FOREIGN PATENT DOCUMENTS

| | | | |
|---|---|---|---|
| EP | 0 960 690 | A1 | 12/1999 |
| EP | 1 693 151 | A2 | 8/2006 |
| EP | 2 067 572 | A2 | 6/2009 |
| EP | 2 138 269 | A1 | 12/2009 |
| JP | 2001-162501 | A | 6/2001 |
| JP | 2006-334701 | A | 12/2006 |

OTHER PUBLICATIONS

Extended European Search Report issued Jun. 17, 2010 in corresponding European application No. 10001142.8.

* cited by examiner

*Primary Examiner* — George Nguyen
(74) *Attorney, Agent, or Firm* — Sughrue Mion, PLLC

(57) ABSTRACT

An eyeglass lens processing apparatus includes: a lens rotation unit rotating a lens; a processing tool rotation unit processing the lens; an axis-to-axis distance changing unit for changing an axis-to-axis distance between the chuck shaft and the processing tool rotation shaft; a lens surface configuration acquiring unit which acquires a front surface curve configuration and a rear surface curve configuration of the lens; a lens outer diameter acquiring unit which acquires an outer diameter of a lens; a calculation unit which calculates a thickness of the lens and calculates a cutting depth of the lens, so that torque applied onto the chuck shaft in rough processing becomes substantially constant, based on the calculated lens thickness and a processing distance from the rotation center of the lens; and a control unit which controls the axis-to-axis distance changing unit in accordance with the calculated cutting depth and for rough processing the lens.

6 Claims, 10 Drawing Sheets

EYEGLASS LENS PROCESSING APPARATUS

BACKGROUND

The present invention relates to an eyeglass lens processing apparatus for processing the periphery of an eyeglass lens.

In an eyeglass lens processing apparatus, an eyeglass lens is held by a pair of lens chuck shafts, the lens is rotated by rotation of the lens chuck shafts, and the periphery of the lens is roughly processed by being pressed to a rough-grinding wheel. When the eyeglass lens is held by the lens chuck shafts, a cup being the fixing jig is fixed on the surface of the lens, and the lens is mounted on a cup holder of one chuck shaft via the cup, and the lens is chucked by a lens holding member of the other lens chuck shaft.

In recent years, a water-repellent lens having a water-repellent substance coated on the lens surface, to which water and oily substances are hardly adhered, has been frequently used. In the processing control that is similar to that of lenses not having any water-repellent substance coated thereon, since the surface of the water-repellent lens is slippery, the attaching position of the cup slips when a rough-grinding wheel is deeply cut in the lens, and the axial angle (that is, the rotation angle of the lens) of the lens comes off with respect to the rotation angle of the lens chuck shaft, wherein there is a problem that a so-called "axial displacement" greatly occurs.

As a method for relieving the "axial displacement," a technique has been proposed (JP-A-2004-255561 and US2004192170), which detects load torque applied onto the lens chuck shaft, decelerates the rotation speed of a lens so that the load torque enters a range of predetermined values or the lens chuck shaft and the grinding wheel rotation shaft are moved so that the distance between the shafts is increased. Also, as another method, a technique has been proposed (JP-A-2006-334701), which rotates the lens at a constant speed, and changes the axis-to-axis distance between the lens chuck shaft and the grinding wheel rotation shaft so that the cutting depth becomes substantially constant when the lens rotates once.

However, further improvement is desired. According to the technique of JP-A-2004-255561, the load torque rapidly exceeds the tolerance of the load torque applied to the lens when the cutting depth increases, and it would be difficult to quickly decrease the torque. Further, if it is controlled that the torque is decreased by rapidly moving the lens away from the grinding wheel, there may be cases where the lens chuck shaft oscillates in the up and down directions.

On the other hand, according to the technique of JP-A-2006-334701, since there is no information regarding the lens thickness that changes due to the point of processing, if a remarkably slight cutting depth is set with safety taken into consideration so that the "axial displacement" does not occur where the thickest lens is assumed, the processing time is lengthened. If the cutting depth is constant, there may be cases where the load torque applied onto the lens chuck shaft exceeds the tolerance at a thick portion of the lens.

SUMMARY

The present invention is made in view of the above-described problems, and it is therefore an object of the invention to provide an eyeglass lens processing apparatus capable of effectively preventing the "axial displacement" from occurring without lengthening the processing time.

In order to solve the above-described problems, the present invention is featured in having the following configurations.

(1) An eyeglass lens processing apparatus comprising:

a lens rotation unit including a motor for rotating a lens chuck shaft for holding a lens;

a processing tool rotation unit including a motor for rotating a processing tool rotation shaft to which a roughing tool for rough-processing a periphery of the lens is attached;

an axis-to-axis distance changing unit including a motor for changing an axis-to-axis distance between the lens chuck shaft and the processing tool rotation shaft;

a lens surface configuration acquiring unit which acquires front and rear surface curve configurations of the lens by measurement or input;

a lens outer diameter acquiring unit which acquires, by measurement or inputting, an outer diameter of the lens before subjected to the processing;

a calculation unit which calculates a thickness of the lens, which changes in accordance with a distance from a rotation center of the lens, every rotation angle of the lens, based on the front and rear surface curve configurations, and calculates a cutting depth of the lens for every predetermined rotation angle of the lens, so that torque applied onto the chuck shaft in the rough-processing becomes substantially constant, based on the calculated lens thickness and a processing distance from the rotation center for every predetermined rotation angle of the lens; and a control unit which controls the axis-to-axis distance changing unit in accordance with the calculated cutting depth to perform rough-processing based on input target lens shape data.

(2) The eyeglass lens processing apparatus according to (1), wherein the calculating unit calculates the lens thickness for every processing distance for every predetermined rotation angle of the lens.

(3) The eyeglass lens processing apparatus according to (1), wherein the processing distance is a distance from the rotation center to the periphery of the lens, or a distance from the rotation center to a center of a rough-processed portion of the lens.

(4) The eyeglass lens processing apparatus according to (1) further comprising a distance detection unit which includes a sensor for detecting the distance between the lens chuck shaft and the processing tool rotation shaft, and which detects the processing distance from the rotation center to the periphery of the rough-processed lens based on an output of the sensor, wherein the calculation unit determines the cutting depth for every predetermined rotation angle of the lens based on the lens outer diameter, which is acquired by the lens outer diameter acquiring unit, in a first-time of rotation of the lens, and determines the cutting depth for every predetermined rotation angle of the lens in the next time of rotation of the lens based on an actual processing distance detected by the distance detection unit in second and subsequent times of rotation of the lens.

(5) The eyeglass lens processing apparatus according to (1), wherein the lens surface configuration acquiring unit includes an edge position detection unit including a measurement element brought into contact with the front and rear surfaces of the lens for detecting edge positions of the front and rear surfaces by detecting movement of the measurement element, and acquires the front and rear surface curve configurations for every predetermined rotation angle of the lens based on the detected edge positions; and the calculation unit determines the lens thickness in a case where the lens is an astigmatic lens for every predetermined rotation angle of the lens based on the detected edge positions and the front and rear surface curve configurations for every predetermined rotation angle of the lens.

(6) The eyeglass lens processing apparatus according to (1) further comprising a memory for storing processing load coefficient generated when predetermined processing volume of the lens is the rough-processed, wherein the calculation unit determines the cutting depth for every rotation angle of the lens, by utilizing a relationship that a value obtained by multiplying the processing volume by the processing distance and the processing load coefficient, becomes the torque applied onto the lens chuck shaft.

BRIEF DESCRIPTION OF THE INVENTION

DESCRIPTION OF EXEMPLARY EMBODIMENTS

Figure 1:
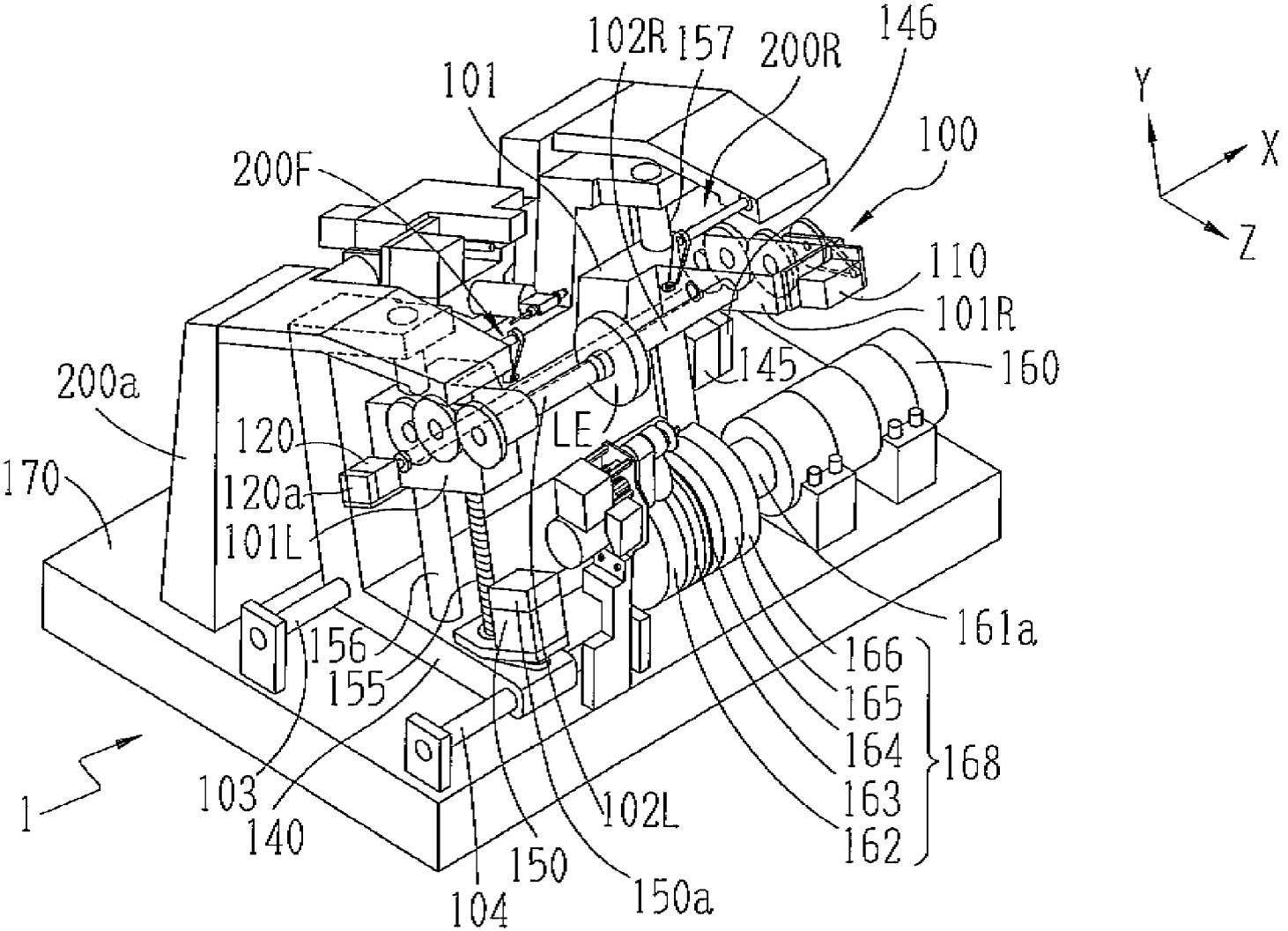
FIG. 1 is a schematic configuration view of a processing portion of an eyeglass lens processing apparatus.

Hereinafter, a description is given of an exemplary embodiment of the present invention. FIG. 1 is a schematic configuration view of a processing portion of an eyeglass lens processing apparatus according to the invention.

A carriage portion 100 is mounted on a base 170 of a processing apparatus main body 1. A periphery of a lens LE to be processed, which is placed between a pair of lens chuck shafts 102L and 102R supported by the carriage 101 holds is pressed against a grinding wheel group 168 of a processing tool coaxially attached to the shaft 161*a* to be processed. The grinding wheel group 168 includes a rough-grinding wheel 162 for glass, a finish-grinding wheel 163 including a bevel inclination to bevel a high-curve lens for high curve beveling, a finish-grinding wheel 164 having a V groove (bevel) VG and a flat-processed surface to bevel a low-curve lens, a flat mirror-finish grinding wheel 165, and a rough-grinding wheel 166 for plastic. The grinding wheel shaft 161*a* is rotated by a motor 160. A processing tool rotation unit is formed in the above manner. In addition, respective processing tools for processing the lens periphery may include a cutter.

The lens chuck shaft 102L is rotatably and coaxially held on the left arm 101L of the carriage 101 while the lens chuck shaft 102R is rotatably and coaxially held on the right arm 101R thereof, respectively. The lens chuck shaft 102R is moved to the lens chuck shaft 102L by a motor 110 at the right arm 101R. The lens LE is held by two lens chuck shafts 102R and 102L. The two lens chuck shafts 102R an 102L are rotated in synchronization via a rotation transmission mechanism such as gears by a motor 120 attached to the left arm 101L. A lens rotation unit is formed in the above manner. An encoder 120*a* for detecting rotations of the lens chuck shafts 102R and 102L is provided on the rotation shaft of the motor 120. The encoder 120*a* is used as a sensor for detecting torque applied onto the lens chuck shafts 102R and 102L when processing the periphery of the lens.

The carriage 101 is mounted on an X-axis movement support base 140 movable along the shafts 103 and 104 extending parallel to the lens chuck shafts 102R and 102L and the grinding wheel shaft 161*a*. A ball screw extending parallel to the shaft 103 is mounted at the back part of the support base 140 (the illustration thereof is omitted), and the ball screw is mounted on a rotation shaft of a motor 145 for X-axis movement. The carriage 101 is linearly moved in the X-axis direction (the axial direction of the lens chuck shafts) along with the support base 140 by rotation of the motor 145. An X-axis direction moving unit is thus formed in the above manner. An encoder 146, which is a detector for detecting movements of the carriage 101 in the X-axis direction, is equipped on the rotation shaft of the motor 145.

In addition, shafts 156 and 157 extending in the Y-axis direction (the direction along which the axis-to-axis distance between the lens chuck shafts 102L, 102R and the grinding wheel shaft 161*a* is caused to change) are fixed on the support base 140. The carriage 101 is mounted on the support base 140 movably in the Y-axis direction along the shafts 156 and 157. A motor 150 for Y-axis movement is fixed on the support base 140. Rotation of the motor 150 is transmitted to the ball screw 155 extending in the Y-axis direction, and the carriage 101 is moved in the Y-axis direction by rotation of the ball screw 155. A Y-axis direction moving unit (an axis-to-axis distance changing unit) is thereby formed in the above manner. The rotation shaft of the motor 150 is provided with an encoder 150*a* that is a detector for detecting movement of the carriage 101 in the Y-axis direction.

Figure 2:
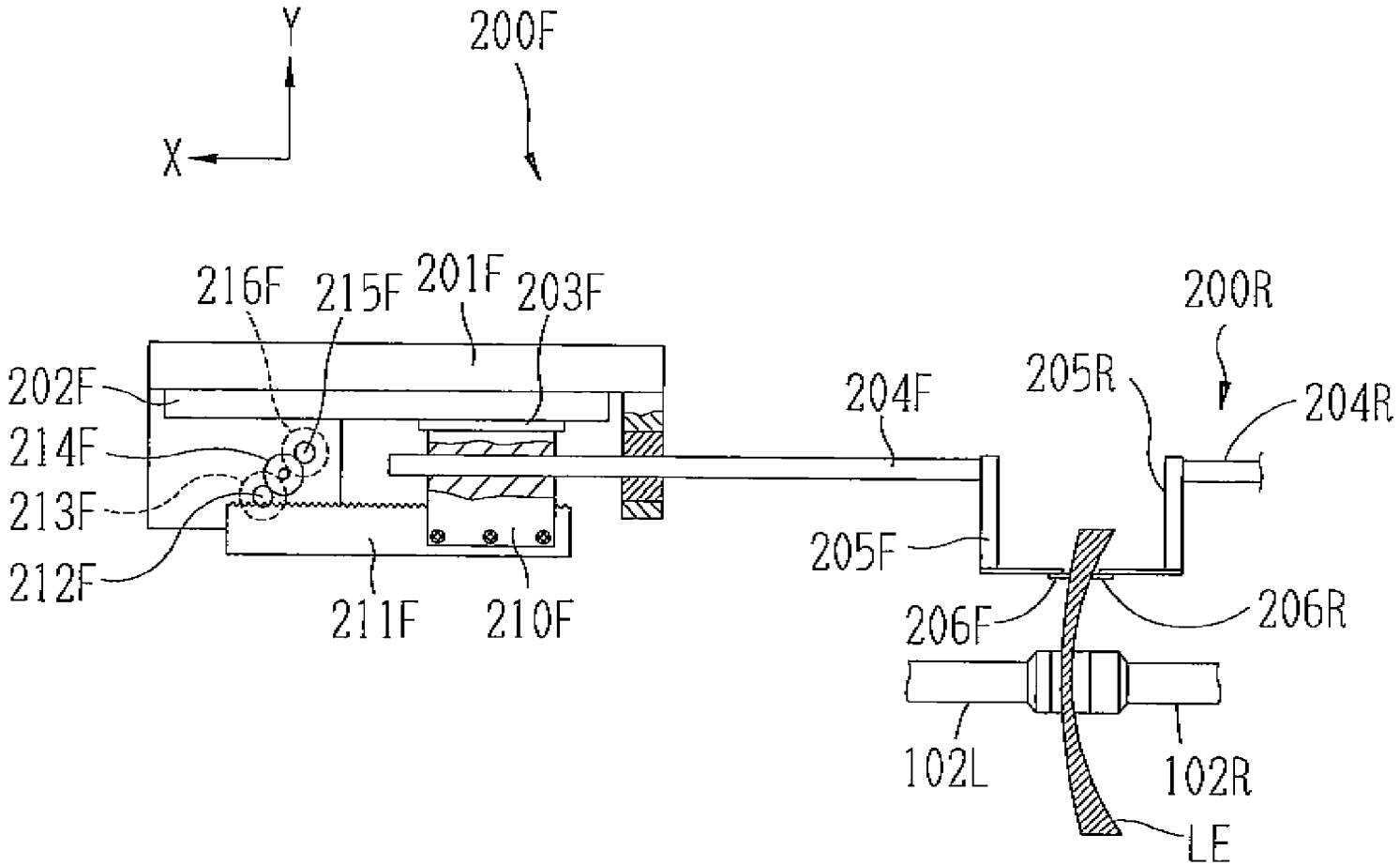
FIG. 2 is a schematic configuration view of a lens edge position measurement portion.

In FIG. 1, lens edge position measurement portions 200F and 200R (lens edge position detection unit) are secured upward of the carriage 101. FIG. 2 is a schematic configuration view of the measurement portion 200F for measuring lens edge positions of the lens front surface. A mounting support base 201F is fixed on the support base block 200*a* fixed on the base 170 of FIG. 1, and a slider 203F is slidably mounted on a rail 202F fixed on the mounting support base 201F. A slider base 210F is fixed on the slider 203F, and a measurement element arm 204F is fixed on the slide base 210F. An L-shaped hand 205F is fixed at the distal end part of the measurement element arm 204F, and a measurement element 206F is fixed at the distal end of the hand 205F. The measurement element 206F is brought into contact with the front side refractive surface of the lens LE.

A rack 211F is fixed at the lower end part of the slide base 210F. The rack 211F is engaged with a pinion 212F of an encoder 213F fixed at the mounting support base 201F side. Also, rotation of a motor 216F is transmitted to the rack 211F via a gear 215F, an idle gear 214F and the pinion 212F, and the slide base 210F is moved in the X-axis direction. While measuring the lens edge position, the motor 216F constantly presses the measurement element 206F to the lens LE at a constant force. The pressing force of the measurement element 206F to the lens refractive surface by the motor 216P is such a light force that the lens refractive surface is not damaged. Publicly known pressing means such as a spring may be used as means for applying a pressing force of the measurement element 206F to the lens refractive surface. The encoder 213F detects the movement position of the measurement element 206F in the X-axis direction by detecting the movement position of the slide base 210F. The edge position of the front surface of the lens LE (including the front surface position of the lens) is measured by the information of the movement position, the information of the rotation angle of the lens chuck shafts 102L and 102R, and the movement information thereof in the Y-axis direction.

Since the structure of the measurement portion 200R for measuring the edge position of the rear surface of the lens LE is left-right symmetrical to the measurement portion 200F, the end code [F] given to respective components of the measurement portion 200F shown in FIG. 2 is replaced by [R], and description thereof is omitted.

When measuring the lens edge position, the measurement element 206F is brought into contact with the lens front surface, and the measurement element 206R is brought into contact with the lens rear surface. In this state, the carriage 101 is moved in the Y-axis direction based on the target lens shape data, and the lens LE is rotated, whereby the edge positions of the lens front surface and rear surface are simultaneously measured for processing the lens periphery. Further, in the lens edge position measurement portion in which the measurement element 206F and the measurement element 2006R are composed so as to be integrally movable in the X-axis direction, the edge positions are separately measured for the lens front surface and the lens rear surface. As described above, basically, since the composition of the carriage portion 100 and the lens edge position measurement portions 200F, 200R is similar to that described in JP-A-2003-145328 (U.S. Pat. No. 6,790,124), a detailed description thereof is omitted.

The X-axis direction moving unit and the Y-axis direction moving unit in the eyeglass lens processing apparatus of FIG. 1 may be formed so that the grinding wheel shaft 161*a* is moved in the X-axis direction and the Y-axis direction relative to the lens chuck shafts (102L, 102R). In addition, with respect to the structure of the lens edge position measurement portions 200F, 200R, the measurement elements 206F, 206R may be formed so as to be moved in the Y-axis direction with respect to the lens chuck shafts (102L, 102R).

Figure 3:
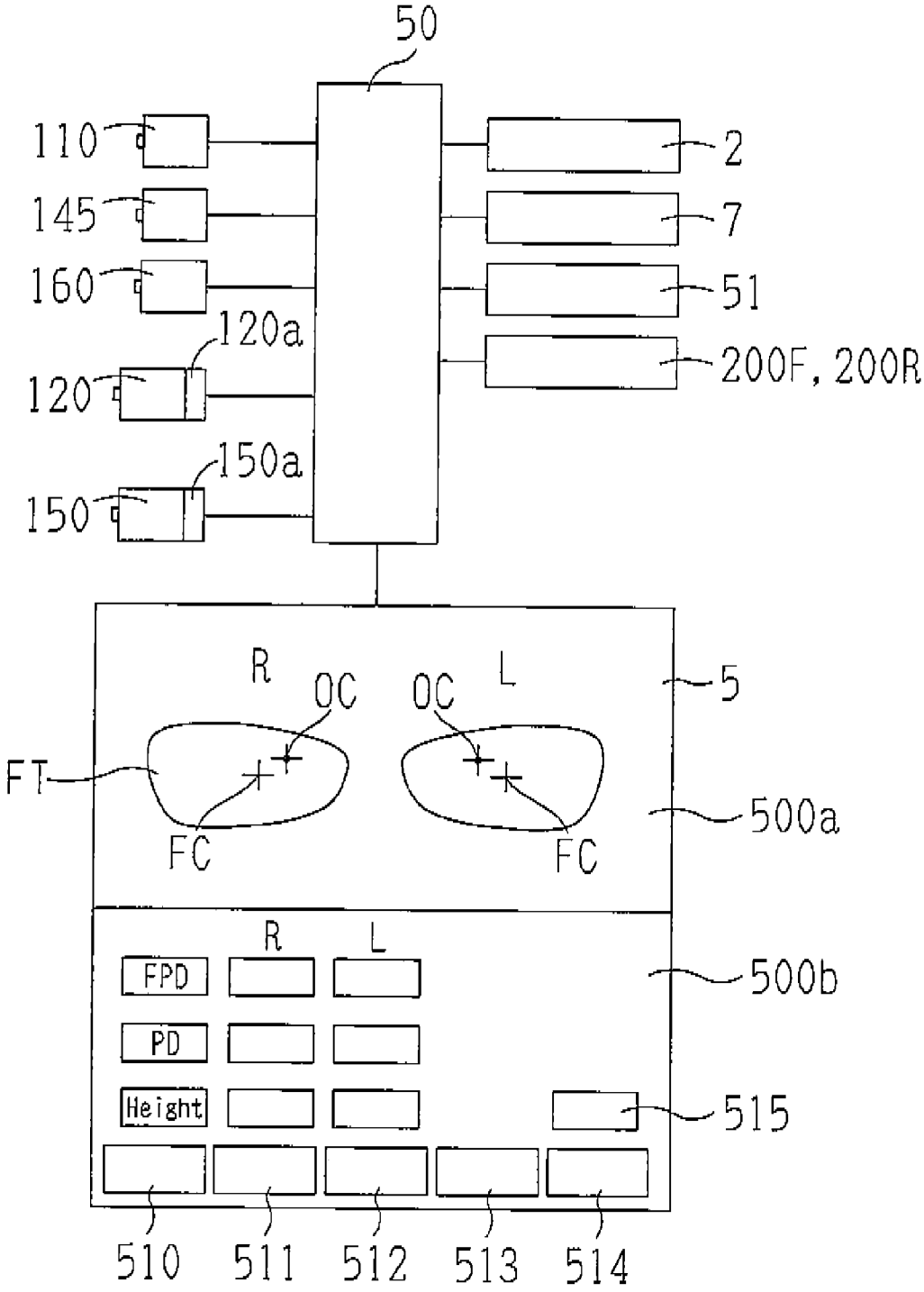
FIG. 3 is a block diagram of a control system of the apparatus.

FIG. 3 is a block diagram of a control system of the apparatus. An eyeglass lens form measurement portion 2 (what is described in JP-A-H4-93164 may be used), a switch portion 7, a memory 51, lens edge position measurement portions 200F, 200R, and a display 5 acting as touch-panel type display unit and inputting unit, etc., are connected to a control portion 50. The control portion 50 receives an input signal by a touch-panel function provided in the display 5, and controls display of figures and information of the display 5. Further, the respective motors 110, 145, 160, 120, and 150 of the carriage portion 100 are connected to the control portion 50.

Next, a description is given of operations of the apparatus. Target lens shape data (rn, θn) (n=1, 2, 3, . . . N) of a lens frame obtained through measurement made by the eyeglass lens configuration measurement portion 2 is input by pressing a switch of the switch portion 7, and is stored in the memory 51. A target lens shape FT based on the input target lens shape data is displayed on the screen 500*a* of the display 5. Layout data such as a distance (PD value) between pupils of a user, a distance (FPD value) between frame centers of an eyeglass frame F, and height of the optical center OC to the geometrical center FC of a target lens shape is brought into a ready-to-input state. The layout data may be input by operating predetermined touch keys displayed on the screen 500*b*. With the touch keys 510, 511, 512 and 513, it is possible to input processing conditions such as a lens material, a frame type, a processing mode, a chamfering process, etc. As for the lens material, a normal plastic lens, a high refractive plastic lens and a polycarbonate lens, etc., may be selected by the touch key 510.

Further, prior to processing the lens LE, an operator fixes a cup Cu (Refer to FIG. 14), which is a fixing jig, to the front surface of the lens LE using a publicly known blocker. At this time, there is an optical center mode in which the cup is fixed at the optical center OC of the lens LE and a frame center mode in which the cup is fixed at the geometrical center FC of the target lens shape. The optical center mode or the frame center mode may be selected by using the touch key 514. In the optical center mode, the optical center OC of the lens LE is chucked by the lens chuck shafts (102L, 102R) and is made into the rotation center of the lens. In the frame center mode, the geometrical center FC of the target lens shape is chucked by the lens chuck shafts and is made into the rotation center of the lens.

In addition, with respect to a water-repellent coated lens having a slippery surface (that is, a water-repellent lens), an "axial displacement" is apt to occur in rough processing. The "axial displacement" refers to such a state where the attaching position of the lens and the cup CU slips and an axial angle of the lens comes off with respect to the rotation angle of the lens chuck shafts. A soft processing mode that is used for processing slippery lenses and a normal processing mode that is used for processing normal plastic lenses not subjected to any water-repellent coating may be selected by the touch key 515 (mode selection switch). Hereinafter, a description is given of a case where the soft processing mode is selected.

Figure 14:
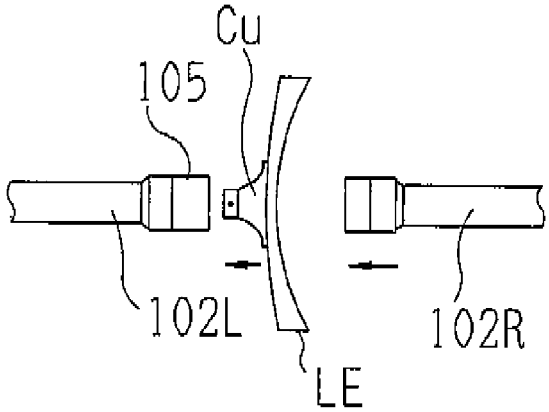
FIG. 14 is a view describing chucking of the lens by means of lens chuck shafts.

An operator inserts the cup CU, which is fixed to the lens LE, into a cup holder 105 secured at the distal end side of the lens chuck shaft 102L (refer to FIG. 14). The lens LE is held on the lens chuck shaft by the lens chuck shaft 102R being moved to the lens LE side by drive of the motor 110. If the start switch of the switch 7 is pressed after the lens LE is held at the lens chuck shaft, the lens edge position measurement portions 200F, 200R are operated by the control portion 50, and a cutting depth by which the load torque applied onto the lens chuck shaft becomes substantially constant is calculated based on the front surface curve configuration and rear surface curve configuration of the lens. Hereinafter, a description is given of calculation of the cutting depth that prevents the axial displacement from occurring in rough processing.

Figure 4:
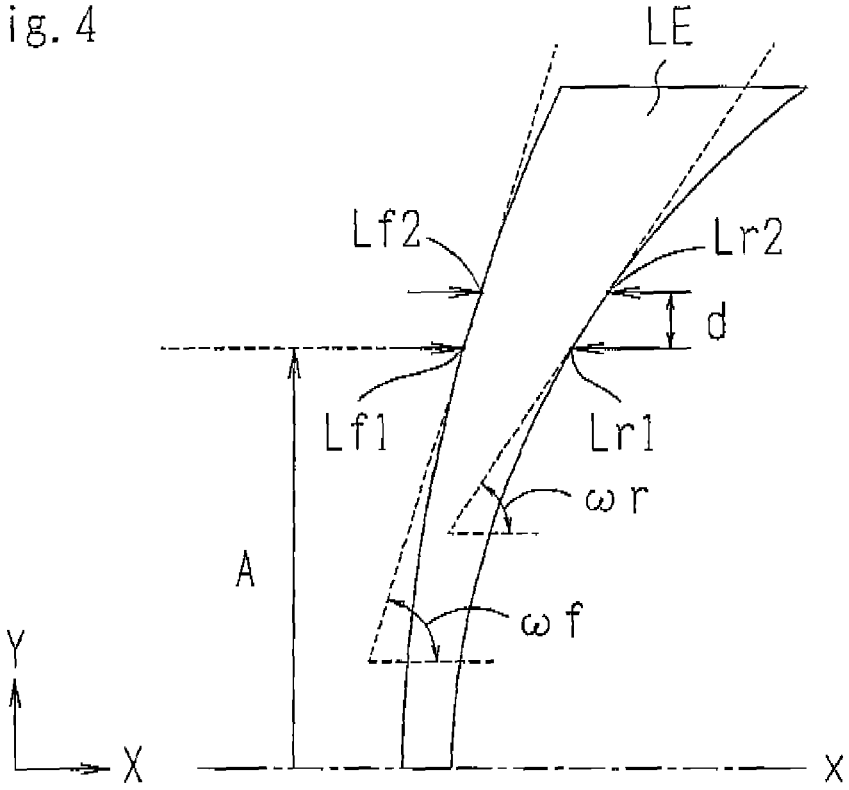
FIG. 4 is a view describing a method for obtaining the front surface curve configuration of a lens and a rear surface curve configuration thereof.

FIG. 4 is a view describing a method for acquiring the lens front surface curve configuration and the lens rear surface curve configuration. The front surface and rear surface edge positions of the lens are measured by the lens edge position measurement portions 200F, 200R in two measurement paths in accordance with the target lens shape data (rn, θn) (N=1, 2, 3, . . . N). The number N of measurement points is, for example, 1000 points. A first measurement path is a path of a radius vector length (rn) of the target lens shape data. The second measurement path is a path apart by a specified distance d (for example, 1 mm) outside the radius vector length (rn) of the target lens shape data. In FIG. 4, the radius vector length (rn) is expressed as A. The measurement element 206F and the measurement element 206R are brought into contact with the positions Lf1 and Lr1 in FIG. 4, respectively, and the positions of the front surface and the rear surface in the X-axis direction of the lens with respect to the first measurement path are measured. Next, the measurement element 206F and the measurement element 206R are brought into contact with the positions Lf2 and Lr2 in FIG. 4, respectively, and the edge positions of the front surface and the rear surface in the X-axis direction of the lens with respect to the second measurement path are measured. In addition, in the following description, it is assumed in order to simplify the description that the rotation center of the lens is the optical center OC of the lens.

An inclination angle ωf of the lens front surface is determined for every predetermined rotation angle θn (dynamic diameter angle) of the lens by a straight line connecting the position Lf1 and the position Lf2 to each other. Further, the inclination angle ωr of the lens rear surface is determined for each rotation angle θn (dynamic diameter angle) of the lens by a straight line connecting the position Lr1 and the position Lr2 to each other.

Next, based on the inclination angle ωf the lens front surface and the inclination angle ωr of the lens rear surface, the lens front surface curve Df of the lens and the rear surface curve Dr thereof are approximately determined by the following mathematical expression.

$$Df[\text{diopter}] = \frac{523 \cdot \cos \omega f}{A} \qquad \text{Mathematical expression 1}$$

$$Dr[\text{diopter}] = \frac{523 \cdot \cos \omega r}{A}$$

Figure 5:
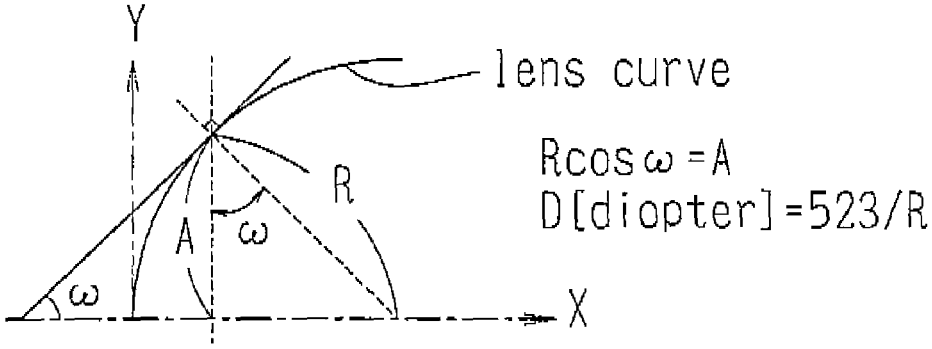
FIG. 5 is a schematic view of calculation for determining a curve D (diopter) from radius R of a lens and an inclination angle ω.

In the mathematical expression 1 described above, Df [diopter] expressing the lens front surface curve and Dr [diopter] expressing the lens rear surface curve are expressed as values obtained by dividing a value 523 by the radius R (mm) of the curve in practice. Calculation for determining the curve D [diopter] based on the curve radius R and the inclination angle ω is supplementarily shown in FIG. 5.

Figure 6:
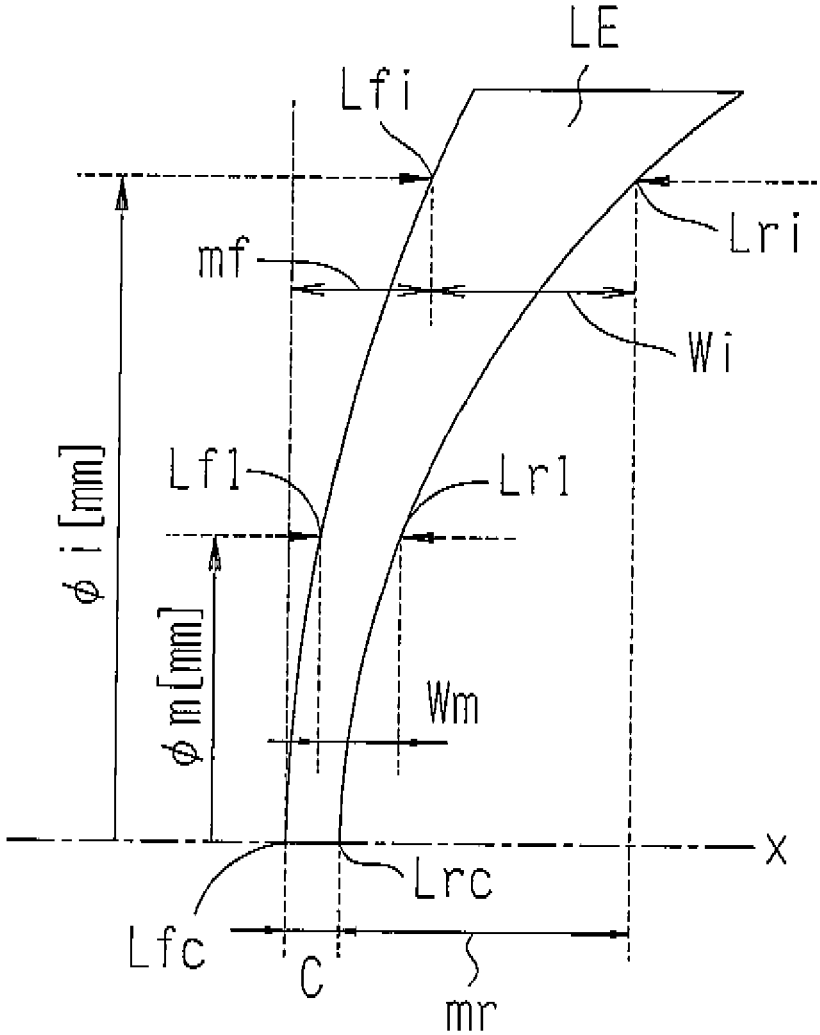
FIG. 6 is a view describing a method for estimating a lens thickness from the curve configurations of the front surface and rear surface of the lens.

Next, a description is given of a method for estimating the lens thickness from the lens front surface and rear surface curve forms, using FIG. 6. FIG. 6 is based on a case where the lens not having any astigmatic component (the front surface and rear surface of the lens is spherical) is assumed. In FIG. 6, it is assumed that the lens thickness at the distance (the processing distance) ϕi[mm] from the processing center to an optional point is Wi[mm]. It is assumed that the distance to the lens front surface position Lf1 at the distance ϕi [mm] from the lens front surface position Lfc on the X axis (the lens chuck shaft) is mf, and similarly the distance to the lens rear surface position Lri at the distance ϕi [mm] from the lens rear surface position Lrc on the X axis is mr. Further, it is assumed that the distance from the position Lfc to the position Lrc on the X axis is C. At this time, the lens thickness Wi at the distance ϕi is determined by the following expression.

$$Wi(\phi i) = mr + C - mf \qquad \text{Mathematical expression 2}$$

Here, the distances mf and mr are determined by the following expressions, respectively.

$$mf = \frac{523}{Df}\left\{1 - \cos\left[\sin^{-1}\left(\frac{\varphi \cdot Df}{523}\right)\right]\right\} \qquad \text{Mathematical expression 3}$$

$$mr = \frac{523}{Dr}\left\{1 - \cos\left[\sin^{-1}\left(\frac{\varphi \cdot Dr}{523}\right)\right]\right\}$$

Figure 7:
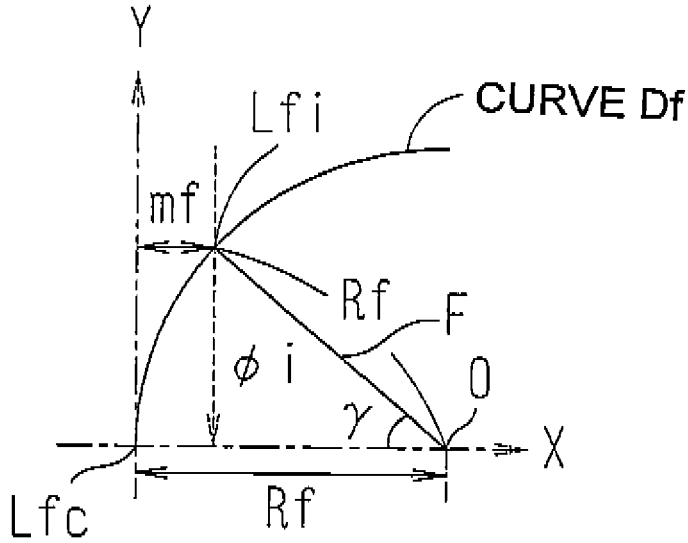
FIG. 7 is a view describing an idea for determining the distance mf of the lens front surface with respect to the lens front surface position on the X axis.

Further, mf of the mathematical expression 3 is obtained from the following expression. In FIG. 7, where it is assumed that an angle formed by a linear segment F connecting the center O of the curve Df of the lens front surface to the position Lfi and the X axis is γ, and the radius of the curve Df is Rf, the following relationship is established.

$$mf = Rf(1 - \cos\gamma) \qquad \text{Mathematical Expression 4}$$

$$Rf \cdot Df = 523$$

$$\gamma = \sin^{-1}\frac{\varphi i}{Rf}$$

What mf is solved in expression 4 described above becomes a mathematical expression to determine mf in expression 3. Based on the idea similar thereto, a mathematical expression to determine mr in expression 3 is brought about.

In FIG. 6, where it is assumed that the distance from the lens front surface position Lf1 to the lens rear surface position Lr1, which has actually been measured with respect to the radius vector length ϕm of the target lens shape is Wm, the distance C (the lens thickness on the X axis) is determined by the following expression by applying FIG. 7 and the idea of expression 4 thereto.

$$C = Wm - \frac{523}{Dr}\left\{1 - \cos\left[\sin^{-1}\left(\frac{\varphi m \cdot Dr}{523}\right)\right]\right\} + \frac{523}{Df}\left\{1 - \cos\left[\sin^{-1}\left(\frac{\varphi m \cdot Df}{523}\right)\right]\right\} \qquad \text{Mathematical Expression 5}$$

Where there is no astigmatic component in the lens LE (that is, in the case of a spherical lens), the values of respective Df and Dr obtained every rotation angle θn (radius vector angle) of the lens are averaged by using the number of the measurement points, and the average value is substituted into expression 3 and expression 4, whereby the lens thickness Wi at an optional distance ϕi is determined.

FIG. 6 refers to a case where it is assumed that there is no astigmatic component (CYL) in the lens LE. However, since an actual lens has an astigmatic component, the lens thickness to which an astigmatic component is reflected as shown below is estimated.

By substituting the radius vector length rn of the target lens shape data into the distance ϕi of expression 3, the lens thickness Wi for each radius vector angle of the entire circumference is determined by expression 2. Wi of the calculation result is made into the lens thickness at the radius vector length rn of the target lens shape data where it is assumed that the lens is a spherical lens. A difference ΔWm between the calculation result and the lens thickness Wm for each radius vector angle of the entire circumference, which is determined by the result brought about by measuring the actual lens edge positions, is calculated. A sinusoidal wave of the difference ΔWm for each radius vector angle is determined, the point where the maximum value exists becomes a strong principal meridian axis, and the point where the minimum value of the sinusoidal wave exists becomes a weak principal meridian axis.

Figure 8:
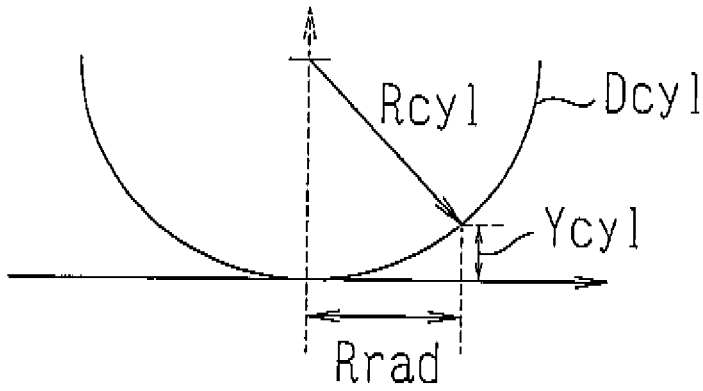
FIG. 8 is a view showing curve Dcyl based on a difference between a strong principal meridian axis of an astigmatic component and a weak principal meridian axis thereof where there is an astigmatic component in the lens.

Next, a lens curve Dcyl [diopter] of the difference between the strong principal meridian axis and the weak principal meridian axis is determined under the same idea as that of expression 1 based on the position Lr1 measured at the first measurement path and the position Lr2 measured at the second measurement path at the radius vector angle of the strong principal meridian axis. As shown in FIG. 8, the lens thickness is estimated from the lens curve Dcyl of the strong principal meridian axis. FIG. 8 is a view showing a curve Dcyl of the difference between the strong principal meridian axis and the weak principal meridian axis. In FIG. 8, Rrad is a distance corresponding to the distance ϕi[mm] on the curve Dcyl. Where it is assumed that the distance to the curve Dcyl at the Rrad is Ycyl, the Ycyl may be determined by the following expression.

$$Ycyl = Rcyl - \sqrt{Rcyl^2 - Rrad^2} \qquad \text{Mathematical Expression 6}$$

$$Rcyl = \frac{523}{Dcyl}$$

Figure 9:
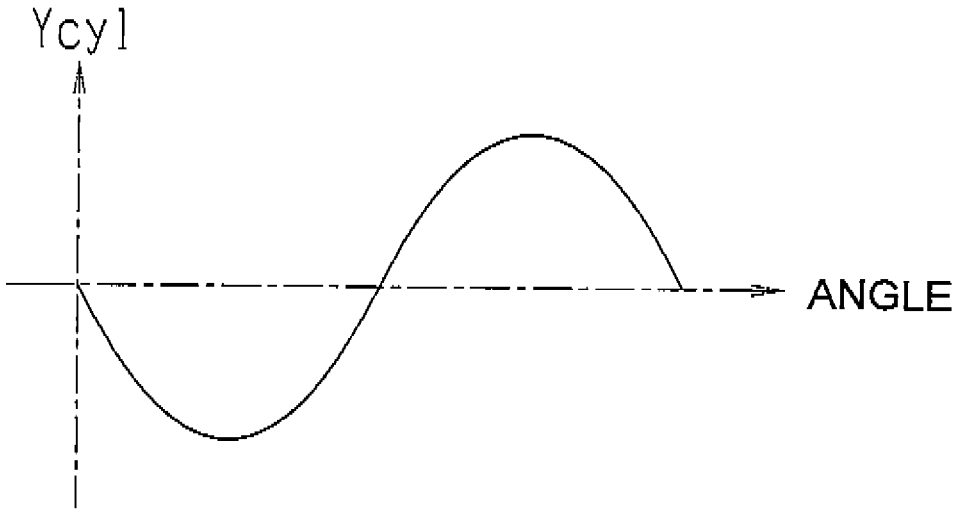
FIG. 9 is a view showing a change in sinusoidal waves of distance Ycyl.

Rcyl determined by the expression described above for each Rrad (ϕi) is added to the lens thickness Wi determined by expression 2, and this is made into a new lens thickness Wi. Since this is a calculation of the lens thickness at the strong principal meridian axis, the lens thickness Wi of the entire circumference is determined by obtaining the curve Dcy every predetermined rotation angle between the weak principal meridian axis and the strong principal meridian axis and carrying out a calculation similar to the above-described expression. For example, by calculating a difference ΔWm for every radius vector angle (for every predetermined rotation angle of lens) at the same radius, a change in sinusoidal waves of the distance Ycyl as shown in FIG. 9 may be obtained. The sinusoidal wave becomes a value showing the toxic surface curve of the astigmatic lens with respect to the spherical lens curve. Therefore, the distance Ycyl for every radius vector angle (the rotation angle of lens) is obtained by a change in the sinusoidal wave, and the lens thickness Wi of an astigmatic lens can be obtained for the entire circumference by adding the distance Ycyl to the lens thickness Wi in the case where the lens is assumed to be spherical.

Next, a description is given of calculation of the cutting depth to make constant the load torque applied onto the lens chuck shaft in rough processing of lens LE by utilizing the lens thickness Wi at the distance ϕi from the rotation center of the lens for every predetermined rotation angle of the lens.

Figure 10:
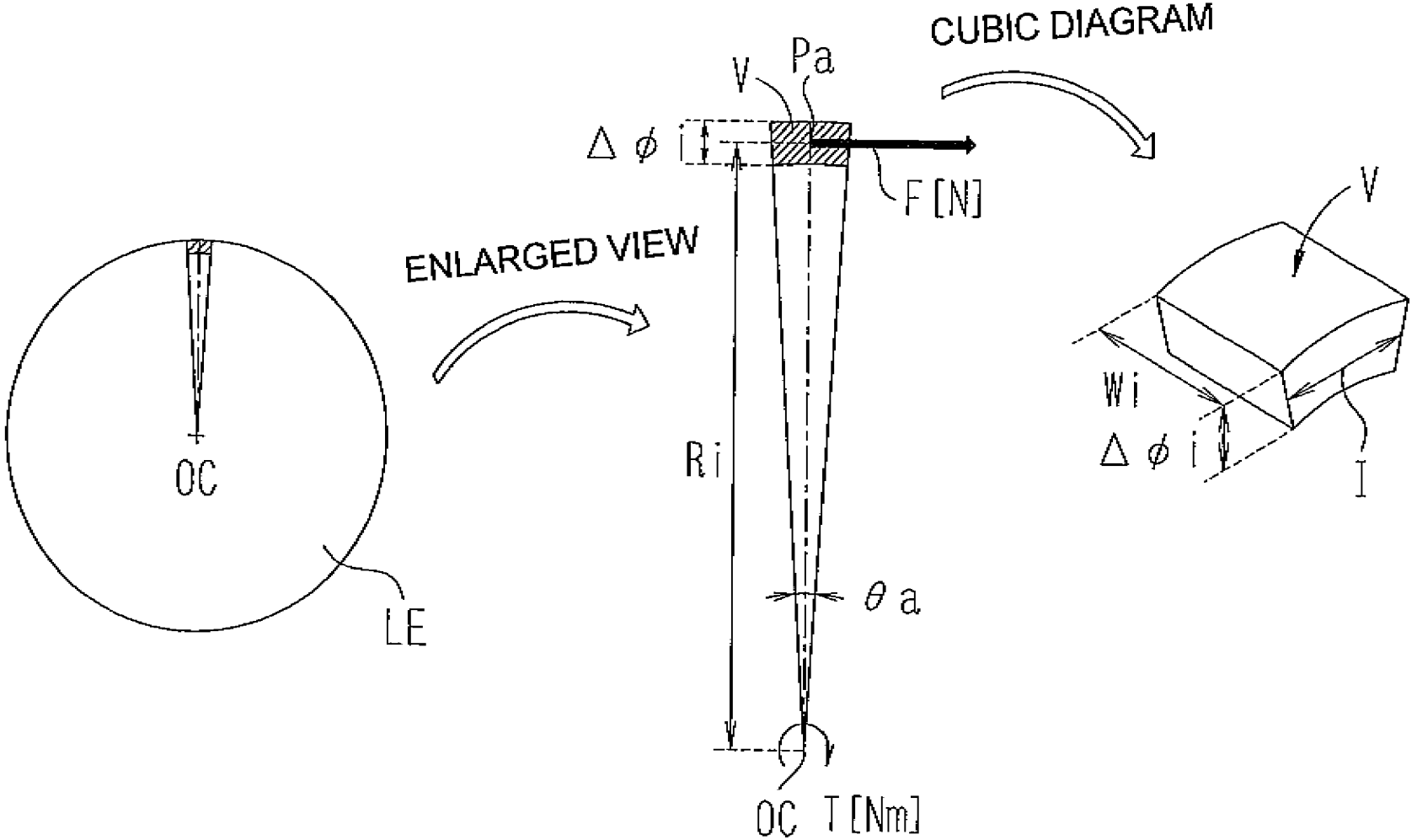
FIG. 10 is a view describing calculations of a cutting depth at which the load torque applied onto the lens chuck shaft is constant.

In FIG. 10, it is assumed that the predetermined unit rotation angle of the lens is θa, the cutting depth is Δϕi, and the processing center point of a portion processed at the unit rotation angle θa and the cutting depth Δϕi is Pa. In addition, it is assumed that the distance from the lens rotation center (OC) to the processing center point Pa is Ri, the lens thickness at the distance Ri1 is Wi, and the cubic volume of the processing portion at this time is V.

If the processing load produced when processing the cubic volume V at the diameter (Ri) of the processing center point Pa is F[N: Newton], the load torque T[Nm] applied onto the lens chuck shaft (hereinafter, θ axis) may be expressed by the following expression.

$$T = Ri \cdot F \qquad \text{Mathematical Expression 7}$$

Here, where it is assumed that the coefficient expressing the processing load generated when processing the predetermined unit volume is N [N:/mm$^3$], the load torque T is converted into the following expression. The processing load coefficient N is a value defined in advance by experiments, and is stored in the memory 51. Further, it is preferable that the processing load coefficient N is determined in accordance with the material of the lens.

$$T = Ri \cdot N \cdot V \qquad \text{Mathematical Expression 8}$$

That is, the load torque T applied onto the lens chuck shaft may be expressed by a value obtained by multiplying the processing volume V by the processing distance Ri and the processing load coefficient N. Since the processing load coefficient N is a constant, the load torque T is a value that is proportional to the distance Ri from the processing center and is proportional to the processing volume V. The cutting depth Δϕi at which the load torque T becomes substantially constant is calculated by utilizing the above-described relationship.

On the other hand, the volume V processed when the lens is rotated only by the unit angle θa may be determined by the following expression. I is a distance (the distance in the direction orthogonal to the distance Ri direction) in the circumferential direction of the processing center point Pa, and is approximately determined by a value brought about by multiplying the distance Ri by 2×tan θa.

$$V = Wi \cdot \Delta\phi i \cdot I = Wi \cdot \Delta\phi i \cdot Ri \cdot 2 \cdot \tan\theta a \qquad \text{Mathematical Expression 9}$$

Based on expressions 8 and 9 described above, the cutting depth Δϕi is solved, and is given by the following expression.

$$\Delta\varphi i = \frac{T}{Wi \cdot ri^2 \cdot 2 \cdot \tan 9a \cdot N} \qquad \text{Mathematical Expression 10}$$

Torque at which the lens does not make any axial displacement is defined by experiments, and in actual rough processing of the lens, the distance Ri from the lens rotation center whenever rotating the lens only by the unit angle θa and the cutting depth Δϕi at which the torque T becomes constant according to the lens thickness Wi at the distance Ri are determined. That is, the cutting depth Δϕi may be a value that can be varied in accordance with the distance Ri and the lens thickness Wi at the distance Ri.

Figure 11:
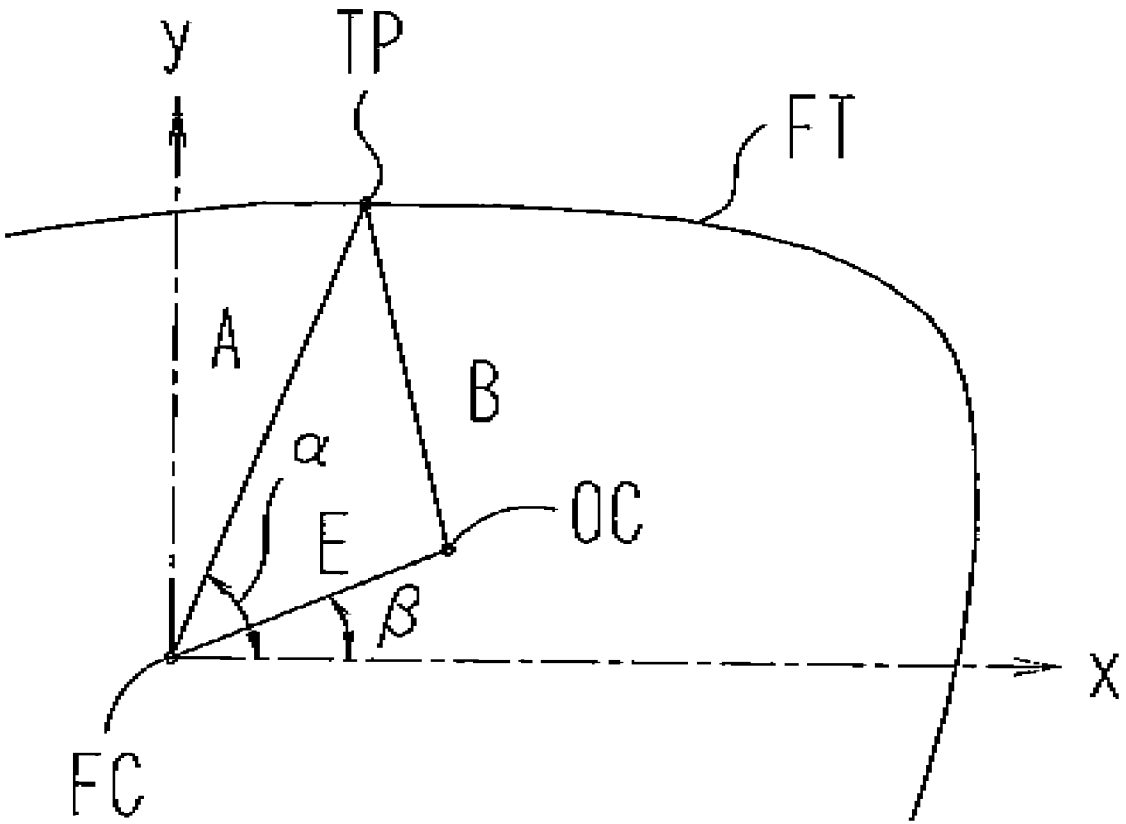
FIG. 11 is a schematic view for correcting respective distances to the distance from the optical center where the rotation center of the lens is located at the geometrical center FC.

It is assumed in the example described above that the rotation center of the lens is located at the optical center OC of the lens. However, where the rotation center of the lens is located at a point other than the optical center OC of the lens, the respective mathematical expressions described above are corrected based on the positional relationship between the optical center OC and the lens rotation center. For example, in a case of a frame center mode in which the lens rotation center is based on the geometrical center FC of a target lens shape, as shown in FIG. 11, a value by which the distance A to the processing point in expression 1 is converted into the distance B from optical center OC is used. In FIG. 11, it is assumed that the distance between the geometrical center FC and the optical center OC is E, the angle formed by a segment (distance A) connecting the center FC and the edge position TP of the target lens shape with respect to the X axis is α, and the angle formed by the segment connecting FC and OC with respect to the X axis is β, and further the position (x, y) of the center OC with respect to the center FC is input based on the layout data, the distance B may be determined by the following expressions based on FIG. 11 and the theorem of cosines.

$$B=\sqrt{A^2+E^2-2AE\cos(\alpha-\beta)}$$

$$E=\sqrt{x^2+y^2}$$

$$\beta=\tan^{-1}(y/x) \qquad \text{Mathematical Expression 11}$$

Figure 12:
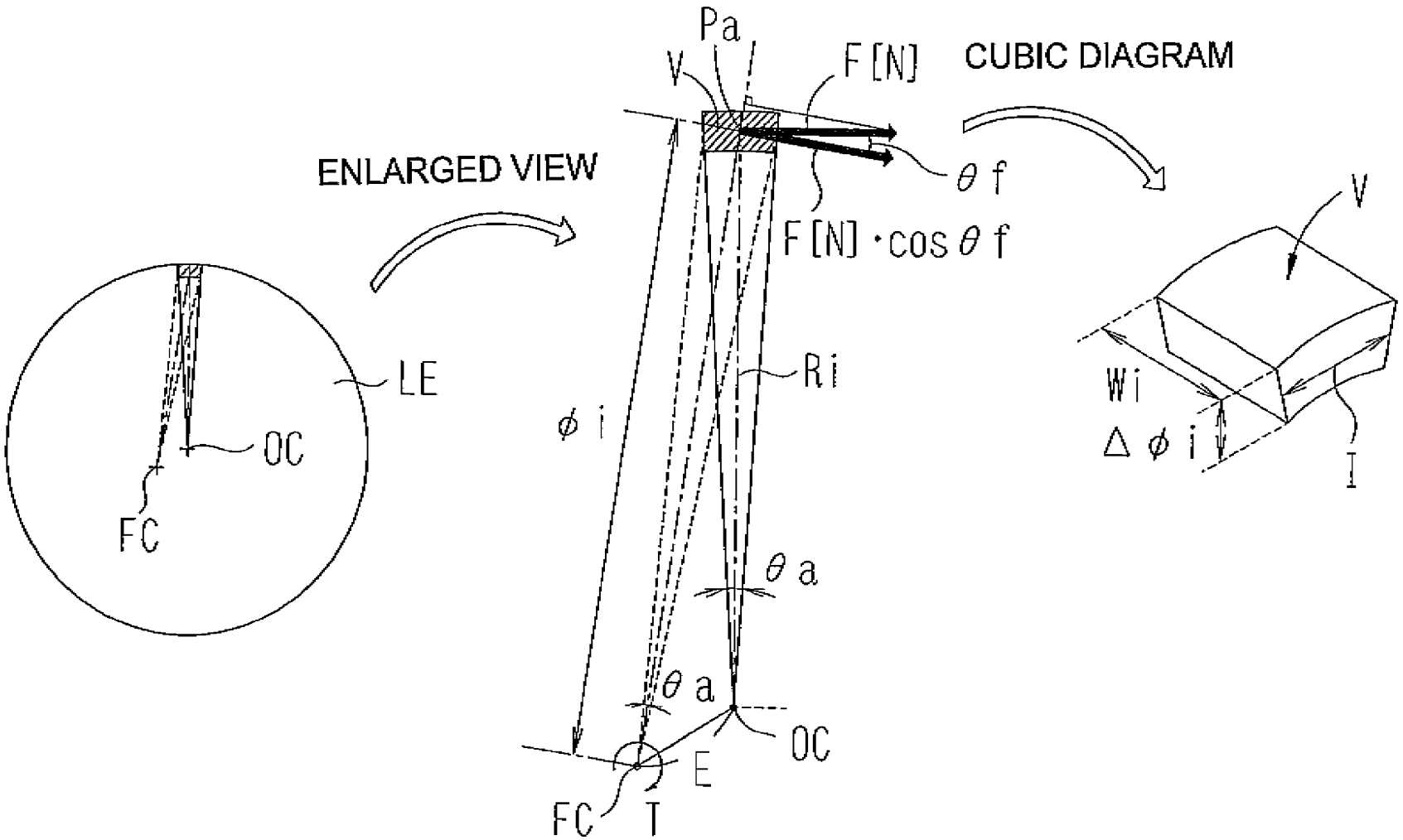
FIG. 12 is a view describing calculations of the cutting depth where the lens rotation center is located at the geometrical center FC.

In addition, FIG. 10 that describes a calculation of the cutting depth Δφi is transformed as in FIG. 12. In FIG. 12, it is assumed that the distance between the geometrical center FC and the optical center OC is E, and the distance from the center FC being the lens rotation center to the processing center point Pa is φi. Since the predetermined unit rotation angle to process the cubic volume V of a processing portion is a minute angle (for example, if the circumference is divided into 1000 points, the predetermined unit rotation angle becomes 0.36 degrees), this can be approximately the same as the rotation angle θa described above. Where the lens rotation center is located at the geometrical center FC, the processing load that is produced when processing the volume V operates in a direction orthogonal to the segment connecting the center FC and the processing center point Pa. The angle formed by the direction and the direction of the processing load F is assumed to be θf.

Expression 8 described above, which shows the load torque T[Nm] applied onto the lens chuck shaft when processing the volume V is converted into the following expression.

$$T=\varphi i\cdot N\cdot V\cos\theta f \qquad \text{Mathematical Expression 12}$$

Cos θf may be determined by the following expression based on FIG. 12.

$$\cos\theta f=\frac{\varphi i^2+Ri^2-E^2}{2\cdot\varphi i\cdot Ri} \qquad \text{Mathematical Expression 13}$$

Further, the volume V processed when the lens is rotated only by the unit angle θa is determined by the following expression.

$$V=Wi\cdot\Delta\varphi i\cdot\varphi i\cdot\tan\theta a \qquad \text{Mathematical Expression 14}$$

If Δφi is solved from the two expressions described above, the cutting depth Δφi is given by the following expression.

$$\Delta\varphi i=\frac{T}{Wi\cdot\varphi i^2\cdot\tan 9a\cdot N\cdot\cos\theta f} \qquad \text{Mathematical Expression 15}$$

By the motor 150 of the axis-to-axis distance changing unit being controlled in accordance with the cutting depth Δφi, the lens is roughly processed in a state where the torque T applied onto the lens chuck shafts is substantially constant.

When the material of the lens is selected by the touch key 510 prior to processing, the processing load coefficient N responsive to the selected material is called from the memory 51, and the cutting depth Δφi is calculated in response to the material of the lens. The processing load coefficient N is a value established by experiments. Where the processing load coefficient of a normal plastic lens is Np1, the processing load coefficient of a high refraction plastic lens is Np2, and the processing load coefficient of a polycarbonate lens is Np3, the processing load coefficient is set so as to become higher in the order of Np1 ⟨Np2 ⟨Np3.

The above description is a basic idea for calculation of the cutting depth Δφi. However, the processing center point Pa shown in FIG. 10 and FIG. 12 is not an already-known value. The processing distance of the processing point, which can be acquired at the beginning, is the outer diameter size of the lens. As described later, the outer diameter size is acquired as a radius rL that is the distance from the rotation center of the lens for every radius vector angle (for every predetermined rotation angle of the lens).

Accordingly, in the first-time rotation of the lens, the periphery of the lens is made into a processing point instead of the processing center point Pa, and the radius rL is substituted in the distance Ri in expression 10 and expression 15, thereby determining a temporary cutting depth Δφi. The cutting depth Δφi is determined again by making the distance obtained by subtracting Δφi×½ from the distance Ri into the distance Ri at the processing center point Pa. The Δφi existing when the difference between Δφi calculated by repeating the above calculation and the Δφ calculated one time before the last rotation of the lens becomes almost equal to each other (that is, becomes a tolerance difference or less) is determined as a cutting depth used for processing. In the second time and subsequent times of rotation of the lens, the distance obtained by subtracting the cutting depth Δφi determined one time before the last rotation of the lens from the distance of the lens periphery before processing is substituted in the distance Ri in expression 10 and expression 15, thereby acquiring the temporary cutting depth Δφi. By repeating the calculations of the temporary cutting depth Δφi, the final cutting depth Δφi is determined. Therefore, it is possible to accurately determine the cutting depth Δφi by which the torque T applied onto the lens chuck shaft becomes substantially constant. Accordingly, the "axial displacement" can be effectively prevented from occurring without lengthening the processing time.

In order to accurately determine the cutting depth Δφi, it is preferable that a temporary cutting depth Δφi as described above is repeatedly determined. However, the temporary cutting depth Δφi first determined based on the distance from the lens rotation center to the processing point of the lens periphery remaining after rough-grinding (in the first-time rotation of the lens, the radius rL of a non-processed lens) may be used, as it is, for rough-grinding. Even in this case, if there is no great difference between the front surface curve of the lens and the rear surface curve thereof, there is little error in practical use. Further, since, in a negative lens, the processing volume V is calculated slightly more than the actual volume, such processing is carried out with emphasis placed on prevention of the "axial displacement". As regards a positive lens, although the processing volume V is calculated slightly less than the actual volume, any practical problem can be reduced if the processing volume V is corrected in accordance with the lens thickness, and the "axial displacement" can be effectively prevented. As to which one of a negative lens or a positive lens, the lens is determined from the result of acquisition of the front surface curve of the lens and the rear surface curve thereof.

Although all of the cutting depths Δφi to the end of tough-grinding may be determined at the beginning, it is preferable that the distance to the periphery of the actual rough processed lens for each one rotation of the lens is detected, and the cutting depth Δφi is determined by using the distance Ri after an actual rough processing. The distance to the periphery of an actual rough processed lens for each one rotation of the lens is obtained based on an output of the encoder 150*a* for detecting the axis-to-axis distance in the Y-axis direction.

A description is given of actual processing operations. If the measurement result of the edge position of the lens front surface and the lens rear surface is obtained by the lens edge position measurement portions 200F and 200R, the cutting depth Δφi to make substantially constant the load torque T applied onto the lens chuck shaft is determined through such calculations as shown above by the control portion 50. Where an edging process is established, path data of the edging position are determined based on the detection result of the edge position of the lens front surface and the lens rear surface and the target lens shape data (a publicly known method may be used with respect to the calculation of the edging path data).

When the lens edge position measurement is completed, the process is advanced to rough processing by the rough-grinding wheel 166. When rough processing is carried out, a measurement step to acquire the outer diameter dimension of a non-processed lens LE is carried out at the beginning. The lens LE is moved to the position of the rough-grinding wheel 166 by movement of the lens chuck shafts 102R and 102L in the X-axis direction. Next, the lens LE is moved to the grinding wheel 166 side by drive of the motor 150. When starting rough processing, for example, the lens LE is rotated by drive of the motor 120 so that the geometrical center FC of the target lens shape, the optical center OC of the lens LE and the rotation center of the rough-grinding wheel 166 (the center of the grinding wheel shaft 161*a*) are aligned on a straight line (on the Y axis). The lens chuck shafts 102R and 102L are moved in the Y axis direction by drive of the motor 150, and the lens LE is brought into contact with the grinding wheel 166. At this time, a drive pulse signal of the motor 150 is compared with a pulse signal output from the encoder 150*a*, and when an error exceeding a predetermined level is brought about in both the signals, it is detected that the lens LB is brought into contact with the rough-grinding wheel 166. The control portion 50 acquires the radius rL being the outer diameter dimension of the lens LED by the following expression based on the axis-to-axis distance La between the centers of the lens chuck shafts 102R, 102L (the geometrical center FC of the target lens shape) and the center of the grinding wheel shaft 161*a*, the distance E between the geometrical center FC and the optical center OC of the lens LE, and the radius RC of the rough-grinding wheel 166.

$$rL=La-E-RC \qquad \text{Mathematical Expression 16}$$

The axis-to-axis distance La is acquired based on a pulse signal from the encoder 150*a* when it is detected that the lens LE is brought into contact with the rough-grinding wheel 166. The distance E is acquired from the FPD value and PD value of input layout data and height data of the optical center OC with respect to the geometrical center FC of a target lens shape. The radius RC of the rough-grinding wheel 166 is an already known value in terms of design and is stored in the memory 51.

Since, in the case of a frame center mode, the geometrical center FC becomes the lens chuck center, the geometrical center is replaced by the lens outer diameter data (rLEn, θn) (n=1, 2, 3, . . . N) centering around the FC, which is the lens chuck center, based on the radius rL and the layout data (data for the positional relationship of the optical center OC and the geometrical center FC).

Although it is preferable that measurement of the outer diameter dimension of the lens LE is carried out after the rough-grinding wheel 166 is stopped rotating, measurement may be carried out while rotating the rough-grinding wheel 166 so as to enable continuous rough processing in order to shorten the rough processing. In this case, since the rough-grinding wheel 166 is rotated, the contacted area of the lens LE is slightly ground. However, since the grinding amount is 1 mm at most, the radius rL of the lens LE may be approximately obtained.

The lens edge position measurement portion 200F or 200R may be used as means for measuring the outer diameter dimension of a non-processed lens LE. For example, the control portion 50 brings, as in FIG. 5, the measurement element 206F of the lens edge position measurement portion 200F (or the measurement element 206R of the lens edge position measurement portion 2008) into contact with a target lens shape FT thereon after the lens LE is rotated so that the straight line connecting the optical center OC to the geometrical center FC of the target lens shape is located on the Y axis. After that, the Y-axis movement of the lens LE is controlled so that the measurement element 206F is moved toward the outer circumference of the lens. If the measurement element 206F comes off from a state where it is in contact with the refractive surface of the lens LE, the detection information of the encoder 213F to detect the edge position quickly changes. By obtaining the axis-to-axis distance in the Y-axis direction by the encoder 150*a*, it is possible to calculate the radius rL being the outer diameter dimension of a before-processing lens LE.

Further, if the outer diameter dimension of a before-processing lens is known in advance, the outer diameter dimension may be acquired by inputting the dimension in a predetermined input screen of the display 5 by an operator.

After a step of acquiring the outer diameter dimension of the lens is finished, as described above, the process is advanced to a step of rough-grinding in accordance with the cutting depth Δφi determined. First, the distance φi when processing the volume V from the processing point of the outer diameter dimension rL of the lens for every predetermined rotation angle θa in the first-time rotation of the lens is determined, and the cutting depth Δφi at this time is determined.

Figure 13:
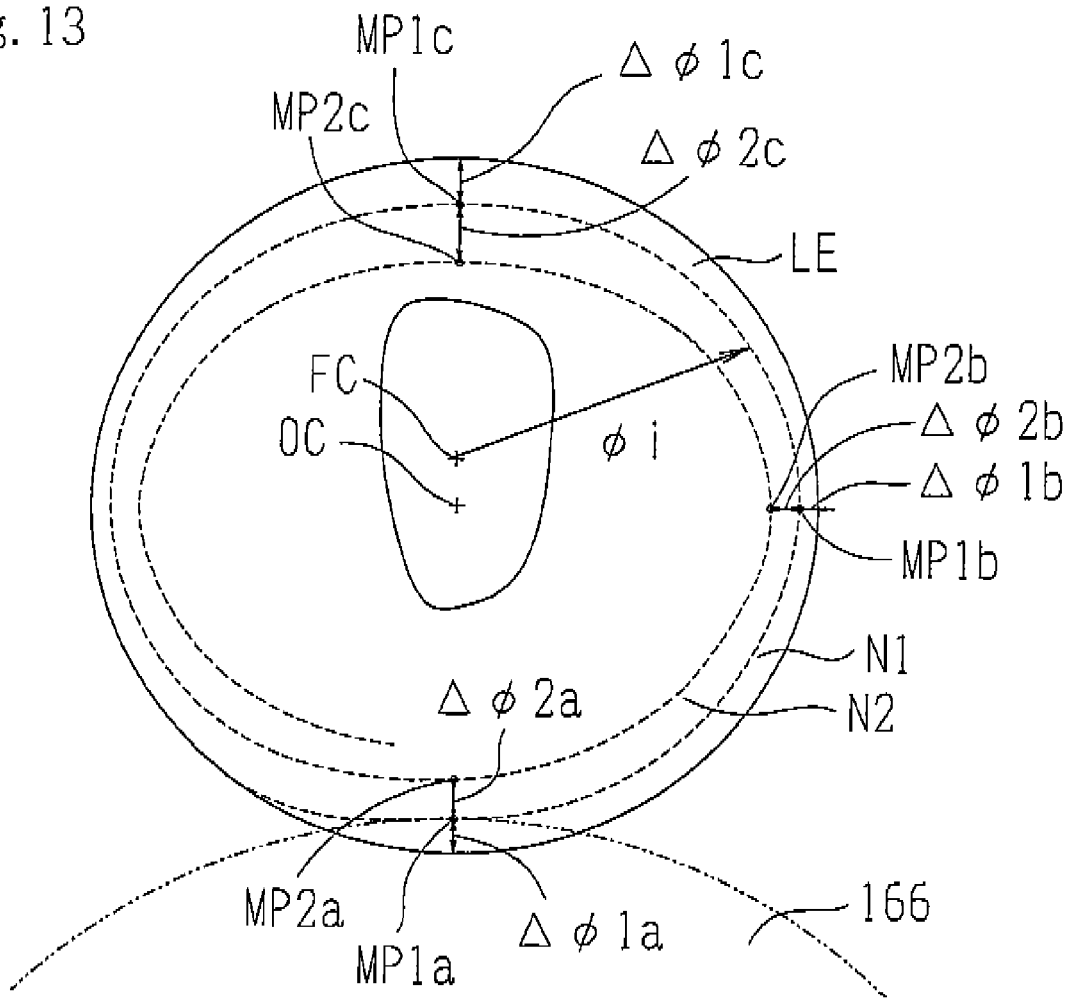
FIG. 13 is a view showing a processing according to the cutting depth.

FIG. 13 is a view showing a processing path in accordance with the cutting depth Δφi. The lens LE is a negative power lens having an astigmatic component (that is, the spherical surface degree is negative), and the geometrical center FC of the target lens shape is held by the lens chuck shafts. In the negative power lens, the lens thickness is thinnest at the optical center OC, and the lens thickness thereof gradually increases toward the outer periphery.

As described above, in the first-time rotation of the lens, the cutting depth Δφi for every predetermined rotation angle of the lens is determined from the measurement result of the outer diameter of the lens with respect to the processing distance from the rotation center of the lens to the periphery thereof, and the processing path N1 for the first-time rotation of the lens is determined. It is assumed that processing is carried out at the cutting depth Δφ1*a* to the point MP1*a* existing on the weak principal meridian axis at the beginning in the processing path of the first-time rotation of the lens. The lens is rotated, and the lens thickness increases to the strong principal meridian axis. At this time, the processing path of the cutting depth Δφi gradually decreases to the point P1*b* existing on the strong principal meridian axis, and the cutting depth Δφ1*b* at the point MP1*b* is obtained with a value that is shorter than Δφ1*a*. The lens is further rotated, and the cutting depth Δφ1*c* at the point MP1*c* existing at the opposite side by 180 degrees of the point MP1*b* is determined with a value that is longer than Δφ1*b*. Since the distance φi from PC being the rotation center at the point MP1*c* is shorter than that at the point MP1*a*, the cutting depth Δφ1*c* by which the load toque T is made substantially constant is determined with a value longer than Δφ1*a*.

At the second-time rotation of the lens, the processing distance for every rotation angle of the lens is determined from the processing path N1, the cutting depth Δφi is thereby determined, and the processing path N2 of the second-time rotation of the lens is determined. When the lens enters the second-time rotation and is processed at the point MP2*a* existing on the same rotation angle as that at the point MP1*a* of the first-time rotation of the lens, the lens thickness gradually becomes thinner toward the optical center OC, and the distance $\phi i$ from the lens rotation center FC is set to be shorter than at the point MP1*a*. Therefore, the cutting depth $\Delta\phi$2*a* when processing at the point MP2*a* is determined with a value longer than the cutting depth $\Delta\phi$1*a* at the first-time rotation of the lens. The cutting depth $\Delta\phi$2*b* at the point MP2*b* existing on the same rotation angle as at the point MP1*b* is determined with a value longer than $\Delta\phi$1*b* at the first-time rotation of the lens because the distance $\phi i$ is shorter than, that at the point MP1*b* and the lens thickness is thinner than that at the point MP1*b*. Where the lens thickness at the point MP2*b* is thicker than that at the point MP2*a*, the cutting depth $\Delta\phi$2*b* is determined with a value shorter than the cutting depth $\Delta\phi$2*a*. Similarly, the cutting depth $\Delta\phi$2*c* at the point MP2*c* on the processing path N2 of the second-time rotation of the lens at the same lens rotation angle as at the processing point MP1*c* is determined with a value that is longer than the cutting depth $\Delta\phi$1*c* and longer than $\Delta\phi$2*a*. Hereinafter, similarly, the cutting depth $\Delta\phi i$ for every rotation angle of the lens in one rotation thereof is determined.

As described above, since the cutting depth $\Delta\phi i$ by which the torque T applied onto the lens chuck shafts (102R, 102L) becomes substantially constant is determined based on the distance $\phi i$ to the periphery for every predetermined rotation angle of the lens and the lens thickness Wi at the distance $\phi i$, rough-grinding can be carried out with the processing time shortened while preventing "axial displacement."

Although the cutting depth by which the torque T becomes substantially constant is determined as described above, such a method may be concurrently employed in which an actual torque TA applied onto the lens chuck shafts (102R, 102L) is monitored in rough processing, and the cutting depth is controlled so that the actual torque TA is entered into a permissible torque $\Delta T$. The actual torque TA is detected by the control portion 50 based on a difference between a rotation command signal (command pulse) to the motor 120 and a detection signal (output pulse) of an actual rotation angle by the encoder 120*a*. Or, by providing a torque sensor on the lens chuck shafts, the torque TA is detected. Where the torque TA exceeds the permissible torque $\Delta T$, at the following rotation angle of the lens, the cutting depth $\Delta\phi i$ determined by a calculation in response to the amount exceeding the permissible torque $\Delta T$ is decreased. A possibility of axial displacement with respect to the lens can be thereby further reduced.

In addition, in actual rough processing of lenses, there may be cases where the lens is not roughly processed as per schedule as like the processing paths N1 and N2. This is brought about by control for decreasing the cutting depth so as not to exceed the permissible torque $\Delta T$ based on the monitoring result of the torque TA as described above. The control portion 50 monitors the electric current flowing to the motor 160 for rotating a roughing tool in rough processing. Where a current exceeding a predetermined level flows to the motor 160, the control portion 50 determines that the processing load is excessive, and controls the motor 150 so as to stop movement of the lens in the Y-axis direction before reaching a planned cutting depth. In such a case, it is preferable that the cutting depth $\Delta\phi i$ in the next one rotation of the lens is determined by detecting the distance to the periphery of an actual rough processed lens and using the distance Ri after an actual, rough processing. The distance to the periphery of the actual rough processed lens for each one rotation of the lens is obtained based on output of the encoder 150*a* that detects the axis-to-axis distance in the Y-axis direction. Determination of the cutting depth $\Delta\phi i$ based on detection of the distance Ri after an actual rough processing includes a case of determination of the cutting depth carried out once every plurality of rotations of the lens.

In the above description, a processing operation applied to the soft processing mode in a case of the lens to which water-repellent coating is applied is described. However, processing control in accordance with the cutting depth $\Delta\phi i$ by which the torque T applied onto the lens chuck shafts becomes substantially constant may be applied in the normal processing mode applied to a normal plastic lens not having water-repellent coating. In this case, the processing load coefficient N used in expressions 8 and 15 is set to a smaller value than in the case of the soft processing mode and is stored in the memory 51. The processing load coefficient N is established by processing experiments of normal plastic lenses. Therefore, since the cutting depth $\Delta\phi i$ determined in accordance with the rotation angle of the lens and the distance of a processing point is determined to be larger in comparison with a case of the soft processing mode, processing can be carried out in a shorter time while preventing the "axial displacement".

What is claimed is:

1. An eyeglass lens processing apparatus comprising:

a lens rotation unit including a motor for rotating a lens chuck shaft for holding a lens;

a processing tool rotation unit including a motor for rotating a processing tool rotation shaft to which a roughing tool for rough-processing a periphery of the lens is attached;

an axis-to-axis distance changing unit including a motor for changing an axis-to-axis distance between the lens chuck shaft and the processing tool rotation shaft;

a lens surface configuration acquiring unit which acquires front and rear surface curve configurations of the lens by measurement or input;

a lens outer diameter acquiring unit which acquires, by measurement or inputting, an outer diameter of the lens before subjected to the processing;

a calculation unit which calculates, for every rotation angle of the lens, a thickness of the lens, which changes in accordance with a distance from a rotation center of the lens, based on the front and rear surface curve configurations, and calculates a cutting depth of the lens for every predetermined rotation angle of the lens, so that torque applied onto the chuck shaft in the rough-processing becomes substantially constant, based on the calculated lens thickness and a processing distance from the rotation center for every predetermined rotation angle of the lens; and a control unit which controls the axis-to-axis distance changing unit in accordance with the calculated cutting depth to perform rough-processing based on input target lens shape data.

2. The eyeglass lens processing apparatus according to claim 1, wherein the calculating unit calculates the lens thickness for every processing distance for every predetermined rotation angle of the lens.

3. The eyeglass lens processing apparatus according to claim 1, wherein the processing distance is a distance from the rotation center to the periphery of the lens, or a distance from the rotation center to a center of a rough-processed portion of the lens.

4. The eyeglass lens processing apparatus according to claim 1 further comprising a distance detection unit which includes a sensor for detecting the distance between the lens chuck shaft and the processing tool rotation shaft, and which detects the processing distance from the rotation center to the periphery of the rough-processed lens based on an output of the sensor, wherein the calculation unit determines the cutting depth for every predetermined rotation angle of the lens based on the lens outer diameter, which is acquired by the lens outer diameter acquiring unit, in a first-time of rotation of the lens, and determines the cutting depth for every predetermined rotation angle of the lens in the next time of rotation of the lens based on an actual processing distance detected by the distance detection unit in second and subsequent times of rotation of the lens.

5. The eyeglass lens processing apparatus according to claim 1, wherein the lens surface configuration acquiring unit includes an edge position detection unit including a measurement element brought into contact with the front and rear surfaces of the lens for detecting edge positions of the front and rear surfaces by detecting movement of the measurement element, and acquires the front and rear surface curve configurations for every predetermined rotation angle of the lens based on the detected edge positions; and the calculation unit determines the lens thickness in a case where the lens is an astigmatic lens for every predetermined rotation angle of the lens based on the detected edge positions and the front and rear surface curve configurations for every predetermined rotation angle of the lens.

6. The eyeglass lens processing apparatus according to claim 1 further comprising a memory for storing processing load coefficient generated when predetermined processing volume of the lens is the rough-processed, wherein the calculation unit determines the cutting depth for every rotation angle of the lens, by utilizing a relationship that a value obtained by multiplying the processing volume by the processing distance and the processing load coefficient, becomes the torque applied onto the lens chuck shaft.

* * * * *